United States Patent [19]

Staron et al.

[11] Patent Number: 4,856,042

[45] Date of Patent: Aug. 8, 1989

[54] DIAPHRAGM FOR ELECTROMAGNET RADIATION BEAM AND ITS USE IN A COLLIMATION DEVICE FOR THIS BEAM

[75] Inventors: Alain Staron, Paris; Christian Claudepierre, Athis-Mons; Francois Micheron, Gif sur Yvette; Edmond Chambron, Gonesse, all of France

[73] Assignee: Thomson-CGR, Paris, France

[21] Appl. No.: 70,938

[22] Filed: Jul. 8, 1987

[30] Foreign Application Priority Data

Jul. 8, 1986 [FR] France ..... 86 09895

[51] Int. Cl.[4] ..... G21K 1/04

[52] U.S. Cl. ..... 378/147; 378/150; 378/151

[58] Field of Search ..... 378/145, 147, 150, 151, 378/161; 354/220, 226, 227.1, 228; 350/266, 267

[56] References Cited

U.S. PATENT DOCUMENTS

| | | | |
|---|---|---|---|
| 2,481,660 | 9/1949 | Harrison . | |
| 2,659,017 | 2/1951 | Bartow | 378/149 |
| 2,871,367 | 1/1959 | Gournay | 378/150 |
| 3,114,043 | 12/1963 | Thomas et al. | 378/150 |
| 3,582,907 | 6/1971 | Taylor et al. | 350/267 |
| 3,805,081 | 4/1974 | Barthel et al. | 378/150 |
| 4,236,360 | 12/1980 | Parrier et al. | 350/267 |
| 4,446,570 | 5/1984 | Guth . | |

FOREIGN PATENT DOCUMENTS 2133701 12/1977 France .

*Primary Examiner*—Carolyn E. Fields
*Assistant Examiner*—David P. Porta
*Attorney, Agent, or Firm*—Oblon, Spivak, McClelland, Maier & Neustadt

[57] ABSTRACT

The diaphragm comprises at least one chamber in which there flows a deformable material that attenuates the radiation beam, the chamber being shaped so that the attenuating material can be introduced from outside the chamber and so that it can surround the passage zone of the beam inside the chamber in such a way that the surface of the passage zone varies constantly with the volume of the material present in the chamber.

10 Claims, 7 Drawing Sheets

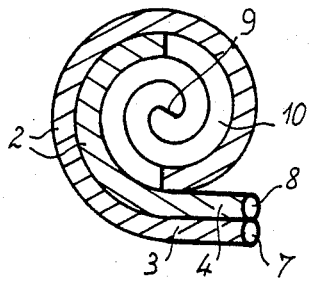
FIG_1-A
FIG_1-B
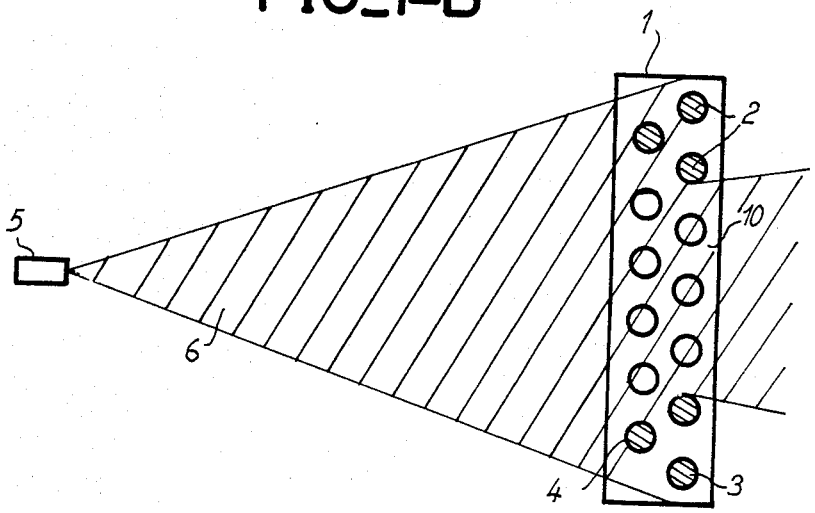

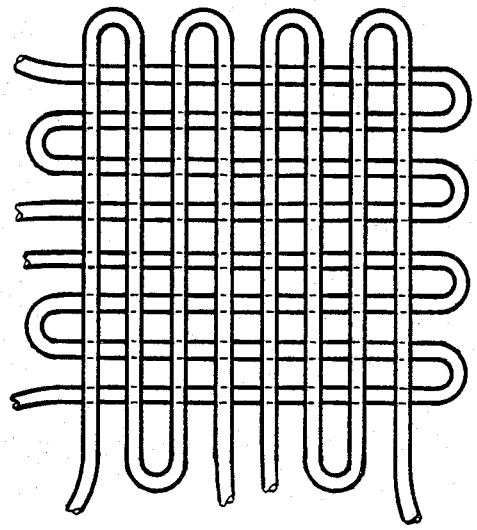
FIG_11
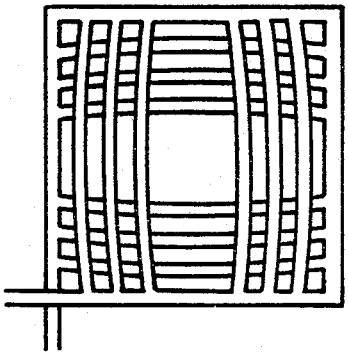
FIG_12
FIG_13
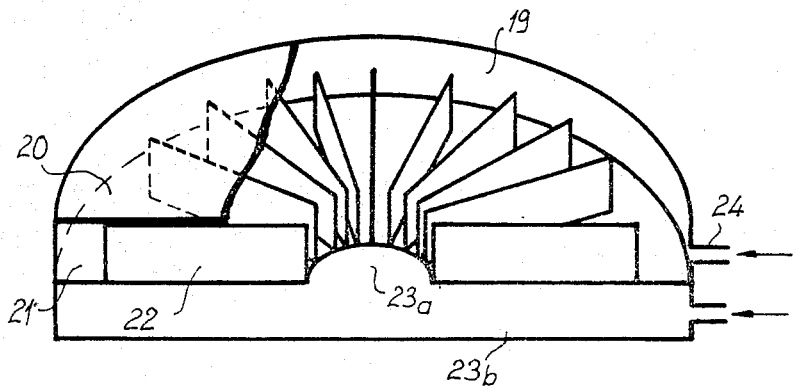

DIAPHRAGM FOR ELECTROMAGNET RADIATION BEAM AND ITS USE IN A COLLIMATION DEVICE FOR THIS BEAM

BACKGROUND OF THE INVENTION

1. Field of the Invention

The present invention pertains to a diaphragm for a beam of electromagnetic radiation and its use in a device for the collimation of this beam.

It can be applied especially in the medical field, to X-ray imaging devices.

2. Description of the Prior Art

At present, diaphragms or irises of collimation devices for electromagnetic radiation are made according to the principle of the photographic camera diaphragm where the beam-limiting agent is arranged in hinged plates which are moved to define a more or less disk-shaped zone for the passage of the beam. The shape of these plates is very precise and depends on the variation desired in the cross-section of the passage. Consequently, when there is a wide range of variations in the cross-section, large rigid plates are used and the equipment is very bulky. The corollary of this geometric constraint is that it is difficult to obtain small cross-sections. Furthermore, the mechanical tolerances have to remain very low.

These difficulties have led to the envisaging of fluid-displacement diaphragms for high energy beams, the said diaphragms comprising, for example, a matrix of channels, perpendicular to the beams, which are filled independently of one another. However, these diaphragms have the disadvantage of requiring complicated means to control the movement of the fluid in each channel. The object of the invention is to remove the above disadvantages.

SUMMARY OF THE INVENTION

For this purpose, the object of the invention is a diaphragm for electromagnetic radiation beams comprising at least one chamber which is transparent to radiation, a chamber in which there flows a deformable material that attenuates the radiation beam, the chamber being shaped so that the attenuating material can be introduced from outside it and so that, inside the chamber, the said attenuating material can surround the zone of passage of the beam in such a way that the area of the zone of passage varies continuously with the volume of the material present in the chamber.

BRIEF DESCRIPTION OF THE DRAWINGS

Other characteristics and advantages of the invention will appear from the following description, made with reference to the appended drawings of which:

FIGS. 1A and 1B respectively show a front and cross-section view of the diaphragm, formed by two juxtaposed spiral ducts;

FIGS. 11 and 12 are other embodiments of rectangular diaphragms;

FIG. 13 is another alternative embodiment of a diaphragm according to the invention;

DETAILED DESCRIPTION OF THE INVENTION

Figure 2:
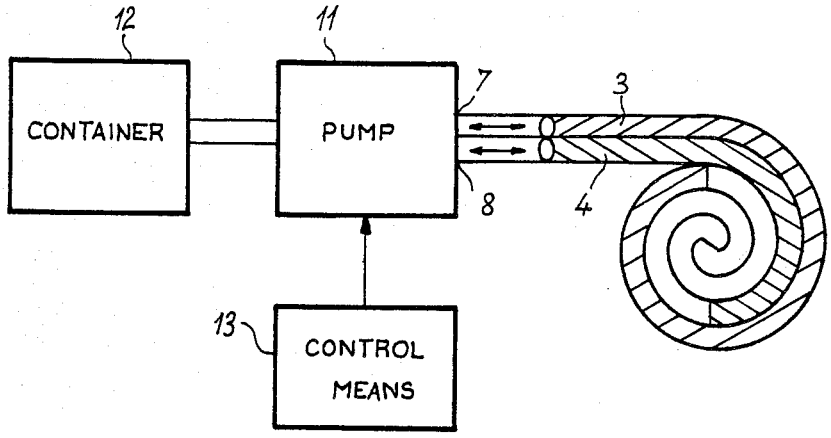
FIG. 2 is a device which can be used to supply opacifier fluid to the ducts of the diaphragm shown in figures 1A and 1B.

A diaphragm for electromagnetic radiation beams according to the invention is shown in FIGS. 1A and 1B. The diaphragm comprises a chamber 1 within which there flows a fluid or solid deformable material 2, which is opaque to the radiation beam and is guided in two spiral-shaped ducts 3 and 4. This diaphragm is shown placed before a source of electromagnetic radiation 5 transmitting a beam of radiation 6 in the direction of the diaphragm. The material 2 is introduced continuously through the ends 7 and 8 of the ducts located at the edge of the spirals. It is pushed or drawn inwards into the said spirals towards their center 9. Thus, the path taken by the material 2 in the ducts 3 and 4 continuously surrounds a section 10 for the passage of a beam 6 through the diaphragm which is thus formed. The section 10 can thus vary constantly with the volume of the material 2 present in each duct 3 and 4 from the edge of the diaphragm, where the ends 7 and 8 of the ducts 3 and 4 are located, up to the center 9 of the two spirals. For example, for X-ray diagnosis, the material 2 can comprise notably mercury or, again, a steel cable or a rope.

To ensure the total opacity of the diaphragm to the radiation beam 6 when the material 2 is present, the two spirals may be advantageously juxtaposed and offset with respect to each other as shown in the cross-section view of FIG. 1B where the spiral turns formed by the duct 3 mask the radiation that crosses the space between the spiral turns of the duct 4.

It is also understood that, to ensure that the passage section 10 is properly transparent to radiation, the walls of the ducts should be formed of a material which is itself transparent to this radiation. For this, plexiglass could be used to achieve this transparency for medical X-ray applications.

For proper functioning, the diaphragm which has just been described should be supplemented by means of actuation to move the material 2 through the ducts 3 and 4. If the material 2 is a solid, and comprises a steel cable, for example, one end of the steel cable may be fastened to any known means of actuation (not shown) capable of pushing or pulling the cable in the ducts 3 and 4.

However, if the material 2 is a fluid, the actuating means should provide for the suction or delivery of the fluid, constantly and as desired, into the ducts 3 and 4 so that it is possible to adjust and set the passage section 10 of the radiation.

These actuating means are shown in FIG. 2 and comprise a suction and delivery pump 11 coupled between the ends 7 and 8 of the ducts 3 and 4, and by a fluid supply container 12, the pump 11 being actuated by electrical control means 13.

If mercury is used as an absorbing fluid, the central outlets of the spirals may be closed, the mercury remaining in contact with a vacuum or with an inert gas under low pressure, or they may be open to provide, if necessary, for the flow of a fluid which is transparent to radiation and which possesses a refractive index which is suited to that of the structure containing it. In the latter case, the device of FIG. 2 as well as the central part 9 of the diaphragm could be modified according to the examples shown in FIGS. 3 to 7 where those elements that are similar to ones of FIGS. 1A, 1B and 2 have been shown with the same references.

Figure 3:
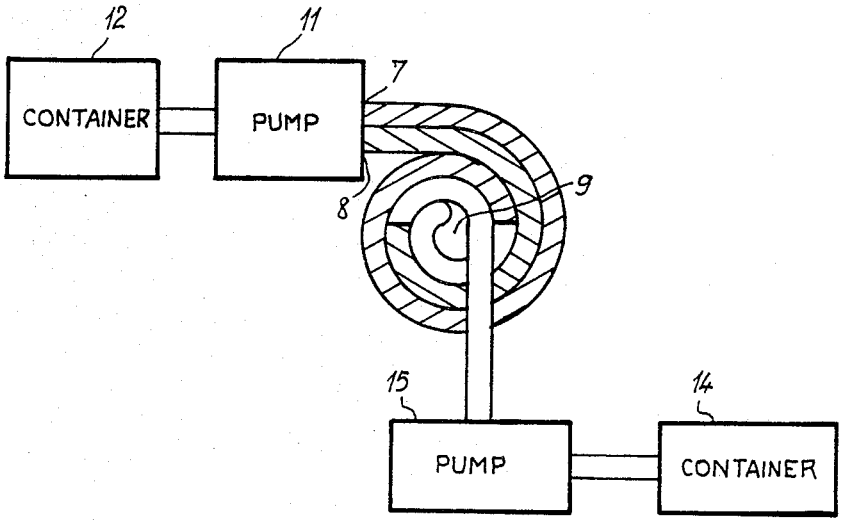
FIGS. 3 to 6 are different embodiments of the device of FIG. 2.

In FIG. 3, a pump 11, placed at one end 7 or 8 or a duct, feeds a spiral with opaque fluid contained in the container 12, and a pump 15, joined to the duct at the center 9 of the spiral, feeds transparent fluid contained in a container 14.

The pumps 11 and 15 take turns to push the opaque and transparent fluid to the end of the duct to which they are connected.

Figure 4:
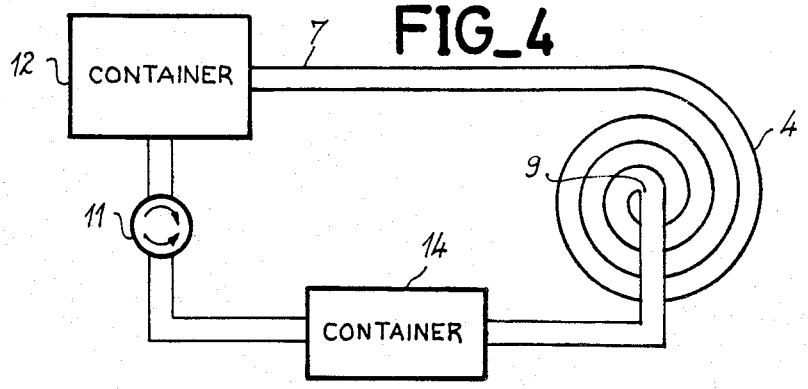
Figure 5:
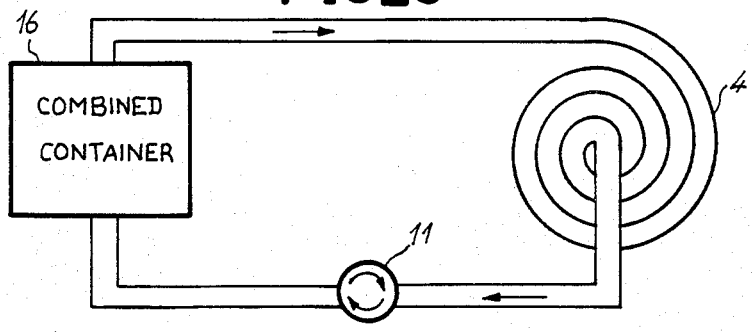
Figure 6:
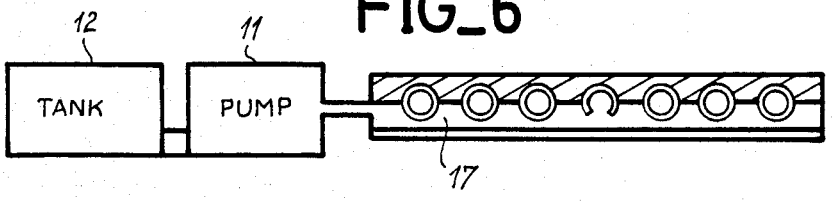
Figure 7:
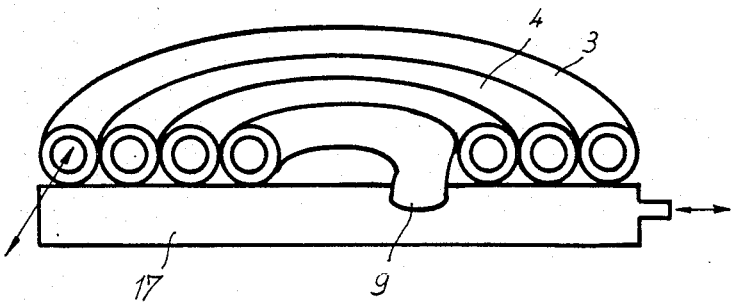
FIG. 7 is an embodiment of a diaphragm provided, on one of its sides, with a container transparent to radiation.

In FIG. 4, a single suction and delivery pump 11 is coupled in a closed circuit between an opaque fluid container 12 and a transparent fluid container 14, one of these containers communicating with one end 7 or 8 of a duct and the other communicating with the other end of the duct located at the center 9 of the spiral. According to another alternative embodiment, namely the device of figure shown in FIG. 5, the two reservoirs 12 and 14 are combined in a single combined container 16. Rather than having containers outside the diaphragm, another solution shown in FIGS. 6 and 7 consists in providing for a container 17 directly at the center 9 at the outlet of a spiral, with the said container 17 communicating directly with this outlet and being transparent to the radiation beam. For example, for an alcohol/mercury diaphragm, the container 17 which is attached to the spiral turns of the diaphragm may advantageously contain alcohol which is the fluid transparent to radiation and, in this case, the pump 11 may work in a closed circuit between the mercury supply container 12 and the alcohol container 17 directly connected to the diaphragm.

Figure 8:
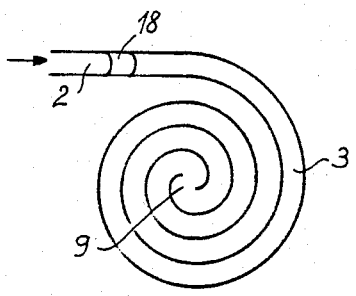
FIG. 8 is an embodiment of a plug to isolate a column of mercury from the external environment within a duct.
Figure 9:
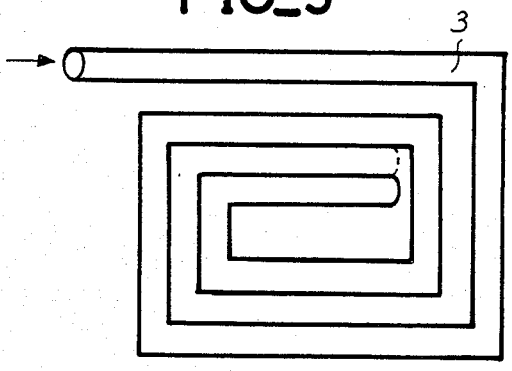
FIG. 9 is an embodiment of a rectangular diaphragm.

It will be noted however that, according to yet another alternative embodiment of the invention shown in FIG. 8, the transparent liquid can be reduced to the state of a plug 18 located in front of the column of opaque liquid which moves with it, the purpose of this plug of alcohol being to prevent oxidation which causes the aging of the mercury and the release of noxious mercury vapour Moreover, the diaphragm of the invention is not limited to the shape of the ducts which have just been described. Instead of being wound in the form of a spiral, the ducts 3 and 4 may be folded several times at right angles in the same direction to form rectangular, contiguous and spiral turns in one and the same plane as shown in FIG. 9, so as to obtain a rectangular diaphragm.

Figure 10:
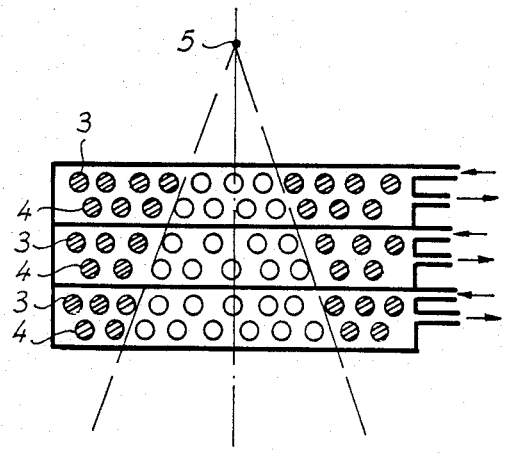
FIG. 10 is a mode of joining several diaphragms according to the invention to collimate a high-energy beam.

Again, as shown in FIG. 10, several diaphragms can be mounted juxtaposed with one another as shown in FIG. 10, each diaphragm being connected to a pumping device of the type described above, thus making it possible to obtain rectangular or circular collimations of the radiation beam as needed.

Other shapes of rectangular diaphragms can also be obtained by organizing the ducts not in the shape of spirals or in the shape of turns at 90° angles as described above, but in the shape of coils which cross one another in a matrix organization of the type shown in the FIGS. 11 and 12, thus making it possible, if necessary, to define non-centered rectangular irradiation fields.

Finally, according to yet another alternative embodiment of a diaphragm according to the invention, shown in FIG. 13, the chamber may comprise an alveolate structure supplied with mercury at its edge and with alcohol at its center. In the example of FIG. 13, the chamber comprises a cylindrical partition 19 which encloses a space between two parallel flat plates 20 and 21. The space between the two plates 20 and 21 is divided into compartments by partitions 22 which define circular sectors, evenly distributed around the center of the plates 20 and 21, on each of the plates A hole $23_a$ drilled at the center of the plate 21, makes the chamber communicate with an alcohol container $23_b$ attached to the plate 21. The mercury is conveyed to the edge of the chamber by a nozzle 24 which crosses the cylindrical partition 19. The partitions 22 are separated from the partition 19 by a space which is sufficient to enable the mercury to penetrate each of the spaces bounded by the partitions 22.

Figure 14:
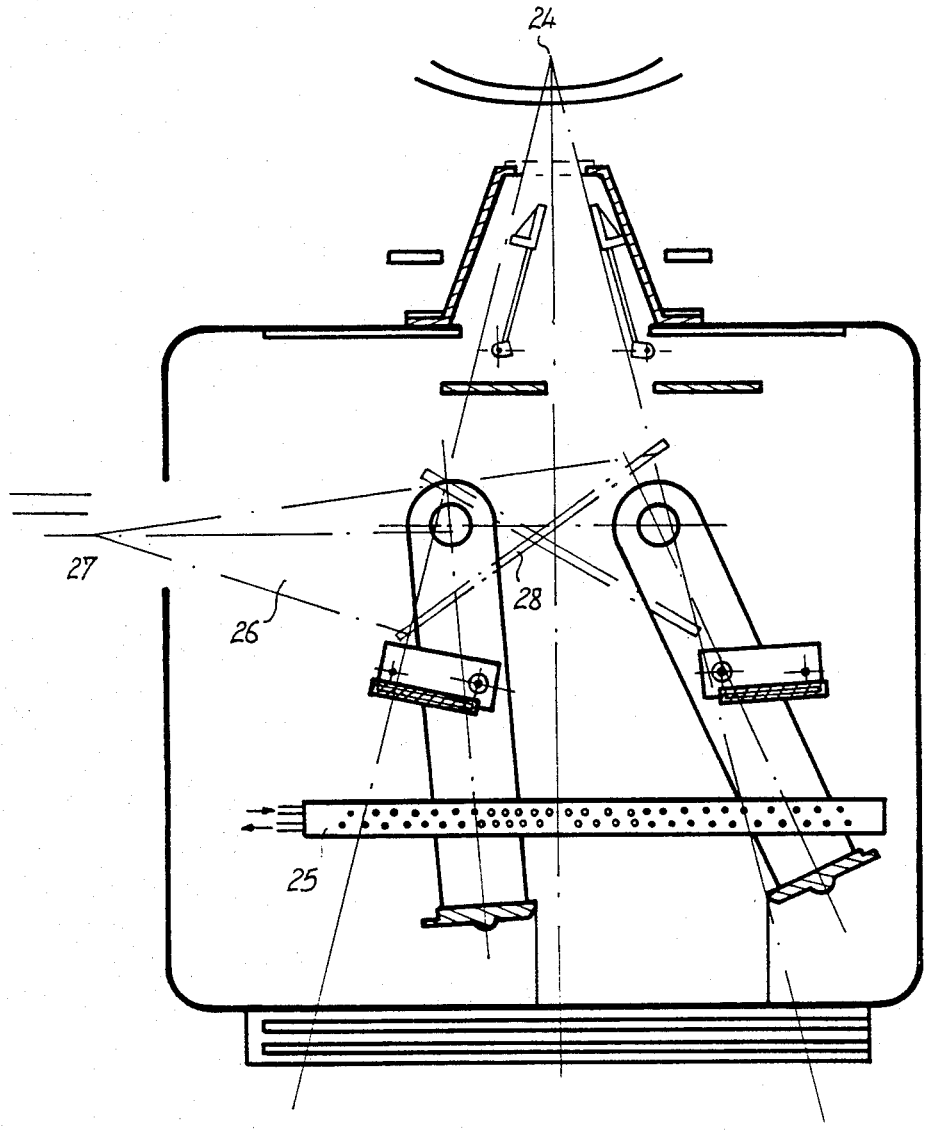
FIG. 14 is an adaptation of a diaphragm according to the invention to an X-ray collimation device.

FIG. 14 shows an adaptation of a diaphragm according to the invention to an X-ray collimation device for X-ray diagnosis instruments.

In FIG. 14, the collimation device comprises, in a known manner, various plates (without references) which are opaque to X-rays and which perform a collimation in a rectangular format of a beam of X-rays from a focal spot 24 so as to adapt this beam to the shapes of rectangular detectors (films) or to the organs of patients subjected to irradiation.

A fluid iris diaphragm 25 according to the invention collimates the X-ray beam emitted by the focal spot 24 in a circular shape, adapting the X-ray beam to the shapes of the detectors of instruments and in particular, to the shapes of the brilliancy amplifiers or to the shapes of the organs to be irradiated. A light beam 26, transmitted by a source 27 through a semi-transparent plate 28, is used to illuminate the diaphragm 25 with the same geometry as the X-ray beam transmitted by the source 24 to center the object to be examined in the beam. In this setting, the transparency of the alcohol and the non-transparency of the mercury enable the collimation of the light beam by the diaphragm 25.

Figure 15:
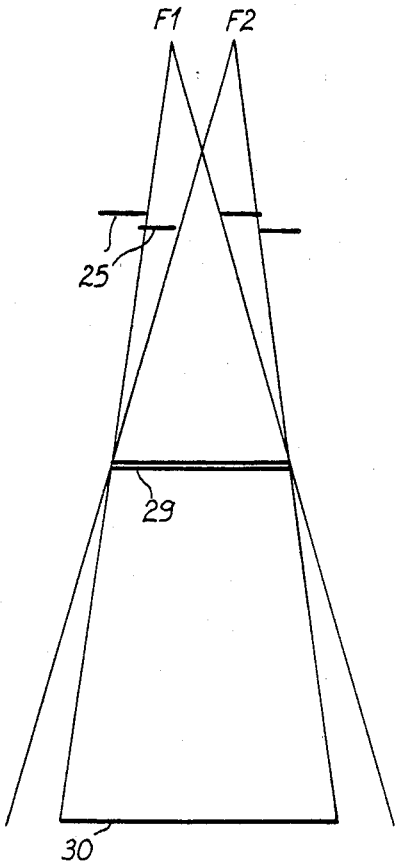
FIG. 15 is an example of the application of the diaphragm according to the invention to the acquisition of stereoscopic images.
Figure 16:
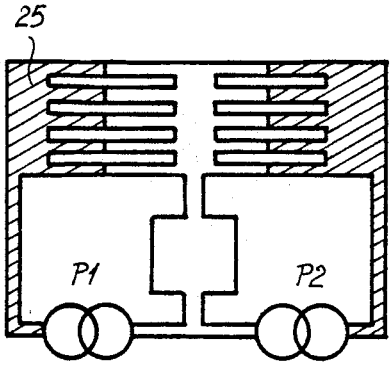
FIG. 16 is an application of the principle shown in FIG. 15.

The low mass put into motion (mercury) gives a quick dynamic range for adapting the size of the beam to the dimension of an object 29 to be examined. For example, in the acquisition of stereoscopic images, it is possible to use an X-ray tube of which two focal spots F1 and F2 are separate, as shown in FIG. 15. The shooting 30 is done alternately on either focal spot, but the acquisition rate can be limited by (among other factors) the putting into motion, due to inertia, of the collimation means 25 which have to shift from one beam to the other in synchronism with the emission of the X-rays A method shown in FIG. 16 makes it possible, by actuating either a pump P1 or a pump P2, to adjust the collimation of a beam of X-rays, by means of a diaphragm 25, to the dimensions of the object examined. Then, by actuating both the pumps P1 and P2 at the same time in one direction and then in the other, it is possible to follow the X-ray beam from the focal spot F1 and then from the focal spot F2.

What is claimed is:

1. A diaphragm for electromagnetic radiation beams, comprising:

at least one chamber in which flows a radiation-beam-attenuating deformable material;

said at least one chamber being shaped so that said deformable material can be introduced from outside said at least one chamber and so that inside said at least one chamber said deformable material can surround a zone of passage of a radiation beam in such a way that the area of the zone of passage varies continuously with the volume of said deformable material in said at least one chamber; and wherein said at least one chamber comprises a first duct wound on itself in the shape of a spiral.

2. A diaphragm according to claim 1, wherein said at least one chamber further comprises:

a spiral-shaped second duct juxtaposed with said first duct in a direction which is perpendicular to a plane whereon the openings of the first and second ducts are located, said first and second ducts being offset with respect to each other so that the spiral turns of one spiral entirely cover the space between the spiral turns of the other spiral, such that a total opacity to radiation in that part of the spirals which is crossed by the deformable material is assured.

3. A diaphragm for electromagnetic radiation beams, comprising:

at least one chamber in which flows a radiation-beam-attenuating deformable material;

said at least one chamber being shaped so that said deformable material can be introduced from outside said at least one chamber and so that inside said at least one chamber said deformable material can surround a zone of passage of a radiation beam in such a way that the area of the zone of passage varies continuously with the volume of said deformable material in said at least one chamber; and wherein said at least one chamber comprises a first duct wound on itself in the shape of a spiral; and wherein a part of the volume of said first duct is occupied by liquid mercury and the remaining volume is filled with a fluid transparent to X-rays; and wherein said fluid transparent to X-rays has a refractive index adapted to that of said first duct.

4. A diaphragm according to claim 3, wherein said at least one chamber further comprises:

a spiral-shaped second duct juxtaposed with said first duct in a direction which is perpendicular to a plate where on the openings of the first and second ducts are located, said first and second ducts being offset with respect to each other so that the spiral turns of one spiral entirely cover the space between the spiral turns of the other spiral so that a total opacity to radiation in that part of the spiral which is crossed by the deformable material is assured.

5. A diaphragm according to claim 3, wherein the end of the duct is closed.

6. A diaphragm for electromagnetic radiation beams, comprising:

at least one chamber in which flows a radiation-beam-attenuating deformable material;

said at least one chamber being shaped so that said deformable material can be introduced from outside said at least one chamber and so that inside said at least one chamber said deformable material can surround a zone of passage of a radiation beam in such a way that the area of the zone of passage varies continuously with the volume of said deformable material in said at least one chamber; and wherein said at least one chamber is formed by a duct folded several times on itself, at right angle and in one and the same lane.

7. A diaphragm for electromagnetic radiation beams according to claim 6, wherein:

part of the volume of said duct is occupied by liquid mercury and the remaining volume is filled with a fluid transparent to x-rays; and wherein said fluid transparent to x-rays has a refractive index adapted to that of said duct.

8. A diaphragm for electromagnetic radiation beams, comprising:

at least one chamber in which flows a radiation-beam-attenuating deformable material;

said at least one chamber being shaped so that said deformable material can be introduced from outside said at least one chamber and so that inside said at least one chamber said deformable material can surround a zone of passage of a radiation beam in such a way that the area of the zone of passage varies continuously with the volume of said deformable material in said at least one chamber; and wherein said at least one chamber comprises an alveolate structure supplied with mercury at its periphery and alcohol at its center.

9. A diaphragm for electromagnetic radiation beams, comprising:

at least one chamber in which flows a radiation-beam-attenuating deformable material;

said at least one chamber being shaped so that said deformable material can be introduced from outside said at least one chamber and so that inside said at least one camber said deformable material can surround a zone of passage of a radiation beam in such a way that the area of the zone of passage varies continuously with the volume of said deformable material in said at least one chamber; and wherein said a least one chamber is formed by at least one coil-shaped duct making it possible to define non-centered, rectangular, irradiation fields.

10. A diaphragm for electromagnetic radiation beams according to claim 9, wherein:

a part of the volume of said duct is occupied by liquid mercury and the remaining volume is filled with a fluid transparent to x-rays, and wherein said fluid transparent to x-rays has a refractive index adapted to that of said duct.

* * * * *